US006253507B1

(12) United States Patent
Martino

(10) Patent No.: US 6,253,507 B1
(45) Date of Patent: Jul. 3, 2001

(54) CLIP FOR A DOOR FRAME SYSTEM

(75) Inventor: Ralph A. Martino, Tampa, FL (US)

(73) Assignee: MDF, Inc., Fort Lauderdale, FL (US)

( * ) Notice: Subject to any disclaimer, the term of this patent is extended or adjusted under 35 U.S.C. 154(b) by 0 days.

(21) Appl. No.: 09/233,190

(22) Filed: Jan. 20, 1999

(51) Int. Cl.[7] ..... E06B 1/04

(52) U.S. Cl. ..... 52/211; 52/204.1; 52/213; 52/204.55; 52/656.4; 52/656.1; 52/656.9; 49/504; 403/404

(58) Field of Search ..... 52/211, 213, 204.55, 52/214, 204.57, 656.1, 656.7, 656.4, 656.9, 658, 631, 204.1; 49/504, 501; 403/404, 403

(56) References Cited

U.S. PATENT DOCUMENTS

| | | | | |
|---|---|---|---|---|
| 3,200,447 | | 8/1965 | Parker . | |
| 3,239,978 | | 3/1966 | Parker . | |
| 3,243,245 | * | 3/1966 | Kewley | 403/402 |
| 3,345,715 | * | 10/1967 | Lambert | 403/402 |
| 3,430,385 | | 3/1969 | Biro . | |
| 3,729,870 | | 5/1973 | Kvalheim et al. . | |
| 4,283,900 | * | 8/1981 | Schubert | 52/712 |
| 4,509,294 | | 4/1985 | Boilard . | |
| 4,676,686 | * | 6/1987 | Eisenloffel | 403/402 |
| 5,671,580 | * | 9/1997 | Chou | 52/656.4 |
| 5,974,745 | * | 11/1999 | Barr | 52/212 |

FOREIGN PATENT DOCUMENTS 2400736 7/1975 (DE) .

* cited by examiner

*Primary Examiner*—Christopher T. Kent
*Assistant Examiner*—Jennifer I. Thissell
(74) *Attorney, Agent, or Firm*—Liniak, Berenato, Longacre & White, LLC

(57) ABSTRACT

A door frame clip is provided for interconnecting first and second door frame members when a longitudinal end of the first door frame member bears against a surface of the second door frame member at a portion of the surface which is adjacent to a longitudinal end of the second door frame member. The door frame clip comprises an apex, a first arm extending from the apex, and a second arm extending from the apex in a direction which is substantially orthogonal to the first arm. The second arm is significantly longer than the first arm to enable the second arm to reach the first door frame member when the apex engages an outside edge of the longitudinal end of the second door frame member. Also provided is a door frame system. The door frame system comprises a first leg member, a second leg member, a header, a first door frame clip, and a second door frame clip. The second leg member is substantially parallel to the first leg member. The header has opposite longitudinal ends which bear against respective surfaces of each of the leg members near a first edge of each of the respective surfaces. The first clip is for interconnecting the first leg member and the header, and the second clip is for interconnecting the second leg member and the header. Also provided is a method of securing a header of a door frame to a first leg member and a second leg member of the door frame.

30 Claims, 7 Drawing Sheets

CLIP FOR A DOOR FRAME SYSTEM

BACKGROUND OF THE INVENTION

The present invention relates to a clip for a door frame system, a door frame system, and a method of interconnecting elements of the door frame system using a clip.

Some doors are commercially available with an assembled door frame. During installation, the door frame is inserted into an opening in a wall or other structure. The door frame then is nailed or otherwise secured to the surrounding structure. Such pre-assembled door frames can occupy a considerable amount of space, and therefore may be bulky and expensive to transport. Many such door frames also include miter cuts at their comers (e.g., at 45 degree angles) or other features which make it difficult to convert the pre-assembled door frame from a left-hand opening configuration to a right-hand opening configuration and vice versa.

It therefore is often desirable to sell, distribute and/or transport door frames in an unassembled state, rather than in the assembled state. Unassembled door frames, however, require assembly when they arrive at an installation site. Until the individual parts of the door frame (e.g., the header and the leg member) are assembled or secured in place, they are awkward to handle. It also it not unusual for the individual parts of the unassembled door frame to become misaligned with respect to one another while they are being secured in place.

There is consequently a need in the art for a convenient and reliable way of securing individual elements of a door frame to one another before and/or after being transported to an installation site, and before insertion into the opening where the door frame will be mounted.

SUMMARY OF THE INVENTION

A primary object of the present invention is to overcome the foregoing problems and/or satisfy the aforementioned need by providing a clip for a door frame system, a door frame system, and a method of interconnecting elements of the door frame system using a clip.

To achieve this and other objects, the present invention provides a door frame clip for interconnecting first and second door frame members when a longitudinal end of the first door frame member bears against a surface of the second door frame member at a portion of the surface which is adjacent to a longitudinal end of the second door frame member. The door frame clip comprises an apex, a first arm extending from the apex, and a second arm extending from the apex in a direction which is substantially orthogonal to the first arm. The second arm is significantly longer than the first arm to enable the second arm to reach the first door frame member when the apex engages an outside edge of the longitudinal end of the second door frame member.

The present invention also provides a door frame system. The door frame system comprises a first leg member, a second leg member, a header, a first clip, and a second clip. The second leg member is substantially parallel to the first leg member. The header has opposite longitudinal ends which bear against respective surfaces of each of the leg members near a first edge of each of the respective surfaces. The first clip is for interconnecting the first leg member and the header. The first clip includes an apex, a first arm extending from the apex, and a second arm extending from the apex in a direction which is substantially orthogonal to the first arm. The second arm is significantly longer than the first arm to enable the second arm to reach the header when the apex engages an outside edge of the first leg member. The second clip is for interconnecting the second leg member and the header. The second clip includes an apex, a first arm extending from the apex of the second clip, and a second arm extending from the apex of the second clip in a direction which is substantially orthogonal to the first arm of the second clip. The second arm of the second clip is significantly longer than the first arm of the second clip to enable the second arm of the second clip to reach the header when the apex of the second clip engages an outside edge of the second leg member.

Also provided by the present invention is a method of securing a header of a door frame to a first leg member and a second leg member of the door frame. The method comprises the steps of: locating the header between the first and second leg members so that the first and second leg members are substantially parallel to one another and so that opposite longitudinal ends of the header bear against respective surfaces of each of the first and second leg members near a first edge of each of the respective surfaces; connecting the first leg member to the header using a first clip, the first clip including an apex, a first arm extending from the apex, and a second arm extending from the apex in a direction which is substantially orthogonal to the first arm, the second arm being significantly longer than the first arm to enable the second arm to reach the header when the apex engages an outside edge of the first leg member; and connecting the second leg member to the header using a second clip, the second clip including an apex, a first arm extending from the apex of the second clip, and a second arm extending from the apex of the second clip in a direction which is substantially orthogonal to the first arm of the second clip, the second arm of the second clip being significantly longer than the first arm of the second clip to enable the second arm of the second clip to reach the header when the apex of the second clip engages an outside edge of the second leg member.

The above and other objects and advantages will become more readily apparent when reference is made to the following description taken in conjunction with the accompanying drawings.

DESCRIPTION OF PREFERRED EMBODIMENTS

Figure 1:
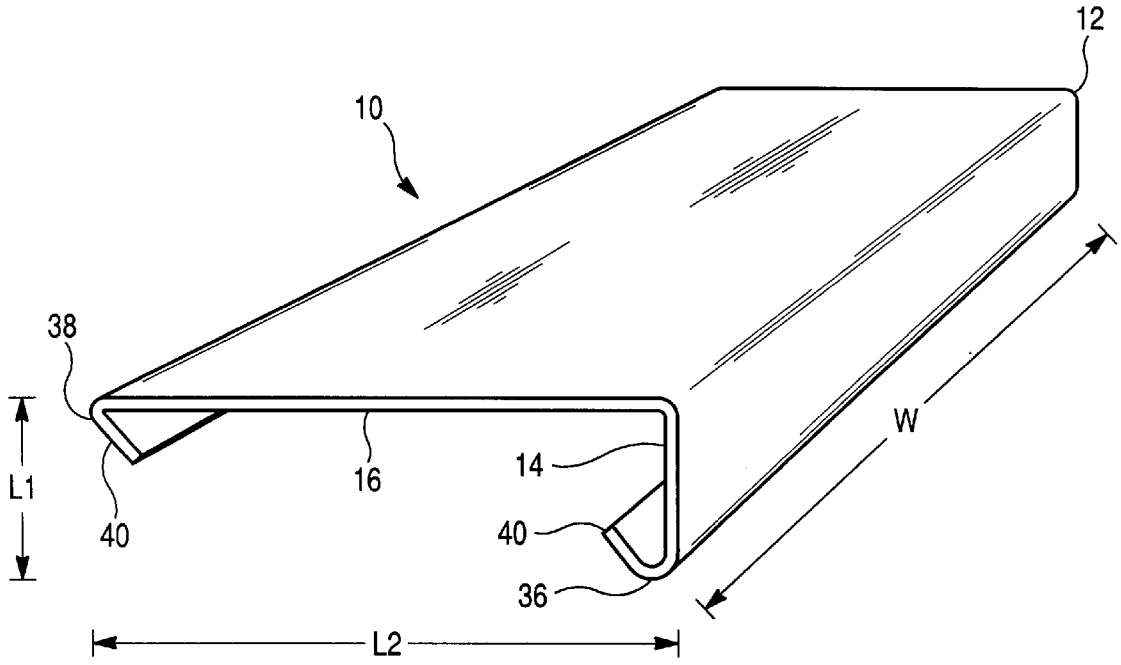
FIG. 1 is a perspective view of a clip according to a preferred embodiment of the present invention.

FIG. 1 illustrates a door frame clip 10 according to a preferred embodiment of the present invention. The door frame clip 10 comprises an apex 12, a first arm 14, and a second arm 16. Both arms 14,16 extend out from the apex 12. The second arm 16 extends out from the apex in a direction which is substantially orthogonal to the first arm 14. The second arm 16 is significantly longer than the first arm 14. Preferably, the second arm 16 is at least three times as long as the first arm 14, and both arms 16,18 are substantially flat.

According to a preferred implementation of the door frame clip 10, the clip is made of eighteen-gauge steel. The present invention, however, is not limited to embodiments made of eighteen-gauge steel. To the contrary, the door frame clip 10 can be provided using other materials, which may or may not include steel.

Preferably, the first arm 14 has a length L1 of about 1 to 1.2 (e.g., 1.1) centimeters, the second arm has a length L2 of about 3 to 3.5 (e.g., 3.3) centimeters, and the entire clip 10 has a width W of about 9 to 10 (e.g., 9.5) centimeters. Such dimensions make the door frame clip 10 compatible with one of a plurality of possible door frame configurations. As the door frame configurations to which the clip 10 will be applied change, it is understood that deviations from the foregoing preferred dimensions may become necessary. In this regard, it is understood that the present invention is not limited to the aforementioned exemplary dimensions.

Figure 2:
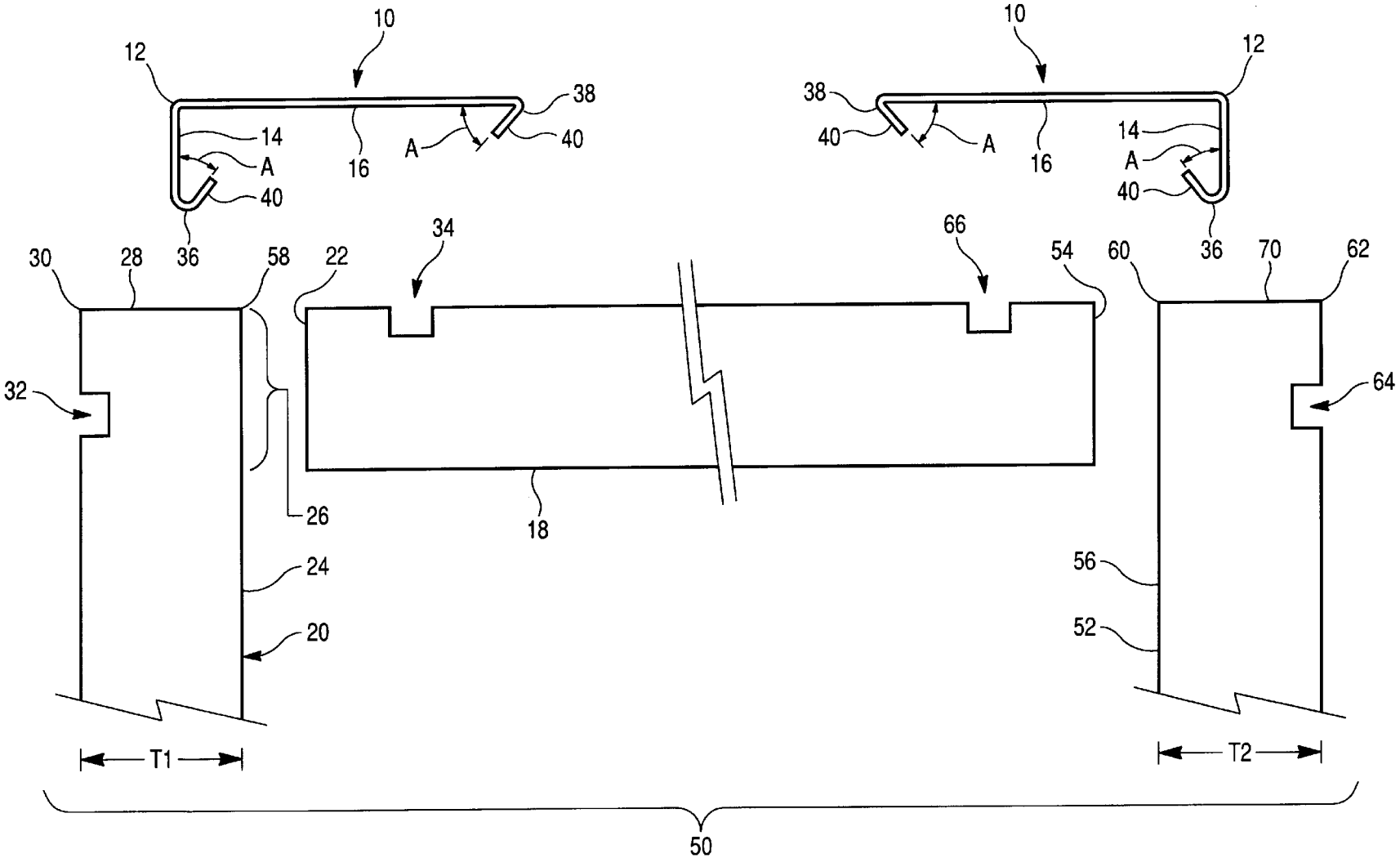
FIG. 2 is a fragmentary, exploded view of a door frame system according to a preferred embodiment of the present invention.

As shown in FIG. 2, the door frame clip 10 is particularly well-suited for use in interconnecting a first door frame member 18 and a second door frame member 20 when a longitudinal end 22 of the first door frame member 18 bears against a surface 24 of the second door frame member at a portion 26 of the surface 24 which is adjacent to a longitudinal end 28 of the second door frame member 20. The extended length of the second arm 16 advantageously enables the second arm 16 to reach the first door frame member 18 when the apex 12 engages an outside edge 30 of the longitudinal end 28 of the second door frame member 20.

Both arms 14,16 preferably project toward one another, and/or have distal ends 36,38 which project toward one another, to engage grooves 32,34 in the second and first door frame members 20,18, respectively. According to the illustrated embodiment, the latter is achieved by providing each distal end 36,38 with a projection 40. The projection 40 preferably extends at an angle A of about 45 degrees from its respective arm 14 or 16. It is understood, however, that the present invention can be practiced using other angles.

As illustrated in FIG. 2, the clip 10 and door frame members 18,20 can be provided as part of a door frame system 50 in accordance with the present invention. In the exemplary door frame system shown in FIG. 2, the first door frame member 18 is a header 18, and the second door frame member 20 is a first leg member 20. The exemplary door frame system 50 therefore includes the first leg member 20, a second leg member 52, the header 18, and two door frame clips 10.

The second leg member 52 is substantially parallel to the first leg member 20. The header 18 has opposite longitudinal ends 22,54 which bear against respective surfaces 24,56 of each of the leg members 20,52 near a first edge 58,60 of each of the respective surfaces 24,56.

One of the clips 10 is used to interconnect the header 18 and the first leg member 20. Notably, the second arm 16 of that clip 10 is significantly longer than the first arm 14 to enable the second arm 16 to reach the header 18 when the apex 12 engages the outside edge 30 of the first leg member 20.

The other of the clips 10 is used to interconnect the header 18 and the second leg member 52. The second arm 16 of this other clip 10 also is significantly longer than the first arm 14 of the same clip 10 to enable the second arm 16 to reach the header 18 when the apex 12 of this other clip 10 engages an outside edge 62 of the second leg member 52.

At least one of the clips 10, and preferably both of the clips 10, have the aforementioned distal ends 36,38 which project toward one another. In the illustrated exemplary embodiment, the first and second arms 14,16 of the first clip 10 (on the left in FIG. 2) have distal ends 36,38 which project toward one another to engage grooves 32,34 in the first leg member 20 and the header 18, respectively. The first and second arms 14,16 of the second clip 10 (on the right in FIG. 2) in the exemplary embodiment also have distal ends 36,38 which project toward one another. The distal ends 36,38 of the second clip 10, however, engage the grooves 64,66 in the second leg member 52 and the header 18, respectively.

Preferably, the first outside groove 32 of the first leg member 20 is offset from the outside edge 30 of the first leg member 20 by a distance corresponding to the distance between the apex 112 of the first clip 10 and the distal end 36 of the first arm 14 of the first clip 10. This distance corresponds to the length L1 shown in FIG. 1. The distal end 36 of the first clip 10 is adapted to engage the first outside groove 32 of the first leg member 20. Preferably, this is achieved by arranging the projection 40 at distal end 36 so that it lockingly extends into the groove 32.

Likewise, the first outside groove 64 of the second leg member 52 is offset from the outside edge 62 of the second leg member 52 by a distance corresponding to the distance between the apex 12 of the second clip 10 and the distal end 36 of the second clip 10. This distance also corresponds to the length Li shown in FIG. 1. The distal end 36 of the second clip 10 is adapted to engage the first outside groove 64 of the second leg member 52. Preferably, this is achieved by arranging the projection 40 at the distal end 36 of the second clip 10 so that the projection 40 lockingly extends into the groove 64.

The projections 40 at the distal ends 36, when combined with the outside grooves 32,64 of the first and second leg members 20,52, provide a convenient and effect way of securing the clips 10 to the leg members 20,52.

A similar arrangement is provided for securing the clips 10 to the header 18. In particular, the header 18 has the aforementioned first and second outside grooves 34,66. The first outside groove 34 is offset from a first longitudinal end 22 of the header 18 by a distance corresponding to the difference between: (a) the distance (i.e., length L2 shown in FIG. 1) from the apex 12 of the first clip 10 to the distal end 38 of the first clip 10 and (b) a thickness T1 (preferably, 1 to 2 centimeters (e.g., 1.5 centimeters)) of the first leg member 20. Preferably, the offset of the groove 34 is substantially equal to the thickness T1, whereby the length L2 is substantially equal to twice the thickness T1 (or twice the offset of the groove 34). The first outside groove 32 of the first leg member 20 preferably is offset from the first outside edge 30 by a distance which is substantially equal to half of the thickness T1.

The distal end 38 of the first clip 10 is adapted to engage the first outside groove 34 of the header 18. Preferably, this is achieved by arranging the projection 40 at the distal end 38 of the first clip 10 so that the projection 40 lockingly extends into the groove 34.

Similarly, the second outside groove 66 of the header 18 is offset from a second longitudinal end 54 of the header 18 by a distance corresponding to the difference between: (a) the distance (i.e., length L2 shown in FIG. 1) from the apex 12 of the second clip 10 to the distal end 38 of the second clip 10 and (b) a thickness T2 of the second leg member 52. Preferably, the offset of the groove 66 is substantially equal to the thickness T2, whereby the length L2 is substantially equal to twice the thickness T2 (or twice the offset of the groove 66).

The first outside groove 64 of the second leg member 52 preferably is offset from the first outside edge 62 by a distance which is substantially equal to half of the thickness T2. The thickness T2 preferably is substantially equal to the thickness T1. In addition, the thickness of the header 18 preferably is substantially equal to the thicknesses T1 and T2 of the first and second leg members 20,52, respectively.

The distal end 38 of the second clip 10 is adapted to engage the second outside groove 66 of the header 18. Preferably, this also is achieved by arranging the projection 40 at the distal end 38 of the second clip 10 so that the projection 40 lockingly extends into the groove 66.

When all of the projections 40 of the distal ends 36,38 extend into their corresponding grooves 32,34,64,66, the door frame system 50 provides a relatively stable door frame assembly which can be installed easily and conveniently in a door opening of appropriate size. Advantageously, the resulting arrangement keeps the header 18 and leg members 20,52 together and properly aligned during the installation process.

In addition, the projections 40 at the distal ends 38 tend to urge the longitudinal ends 22,54 of the header 18 tightly against the surfaces 24,56, respectively, of the leg members 20,52. Any forces urging the surfaces 24,54 away from the ends 22,54 have the effect of more tightly drawing the projections 40 of the distal ends 36 into their respective grooves 64,32. Since the ends 22,54 and surfaces 24,56 are not miter-cut (or otherwise cut at an angle), the aforementioned urging provided by the projections 40 advantageously does not tend to cause sliding of the ends 22,54 with respect to the surfaces 24,56. Moreover, the weight of the structure above the header 18 is carried primarily by the ends 28,70 of the leg members 20,52. The weight of the structure above the header 18, in a miter-cut arrangement, by contrast, tends to urge the leg members 20,52 away from each other.

Figure 3:
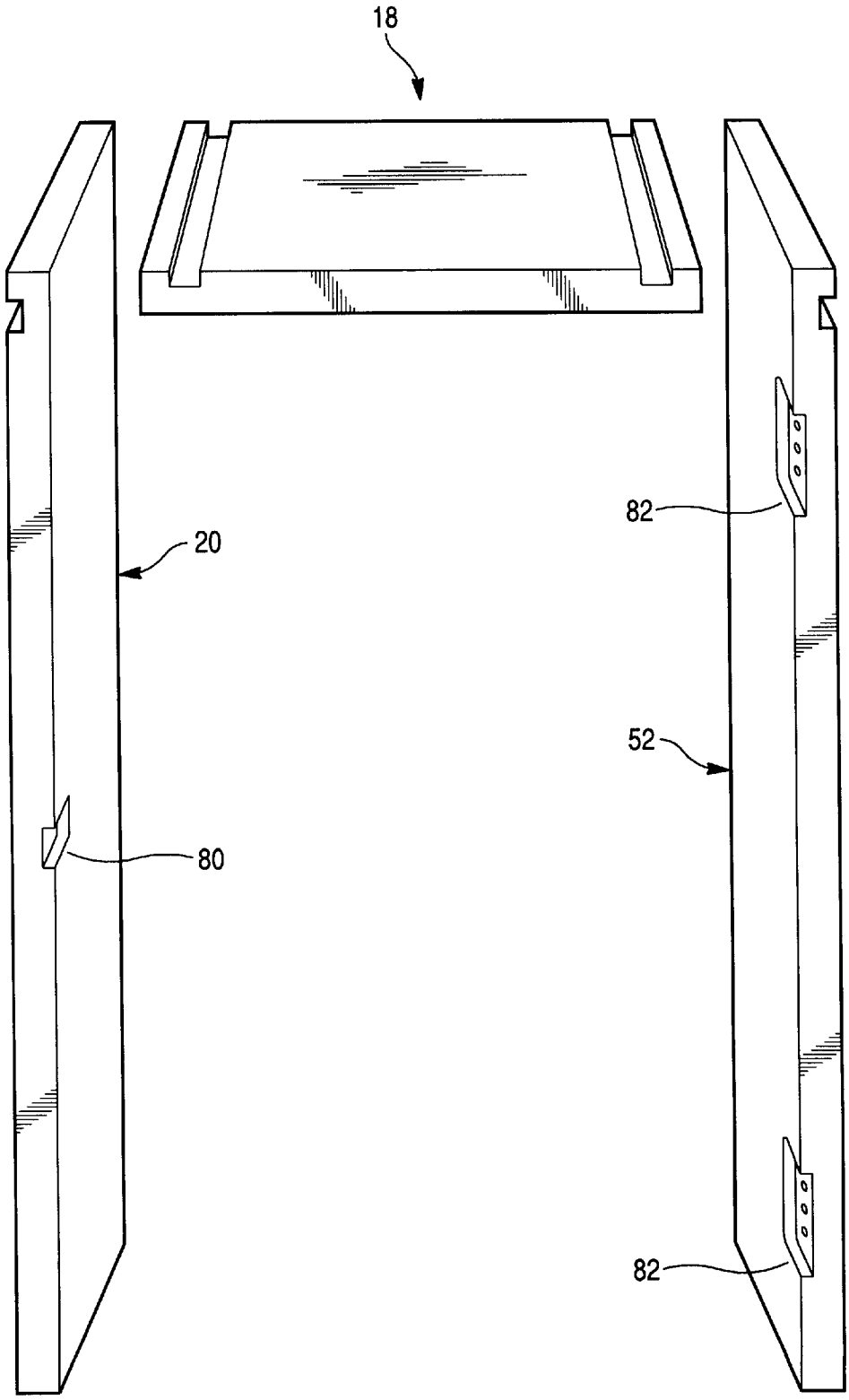
FIG. 3 is an exploded view of door frame elements shown in FIG. 2.
Figure 4:
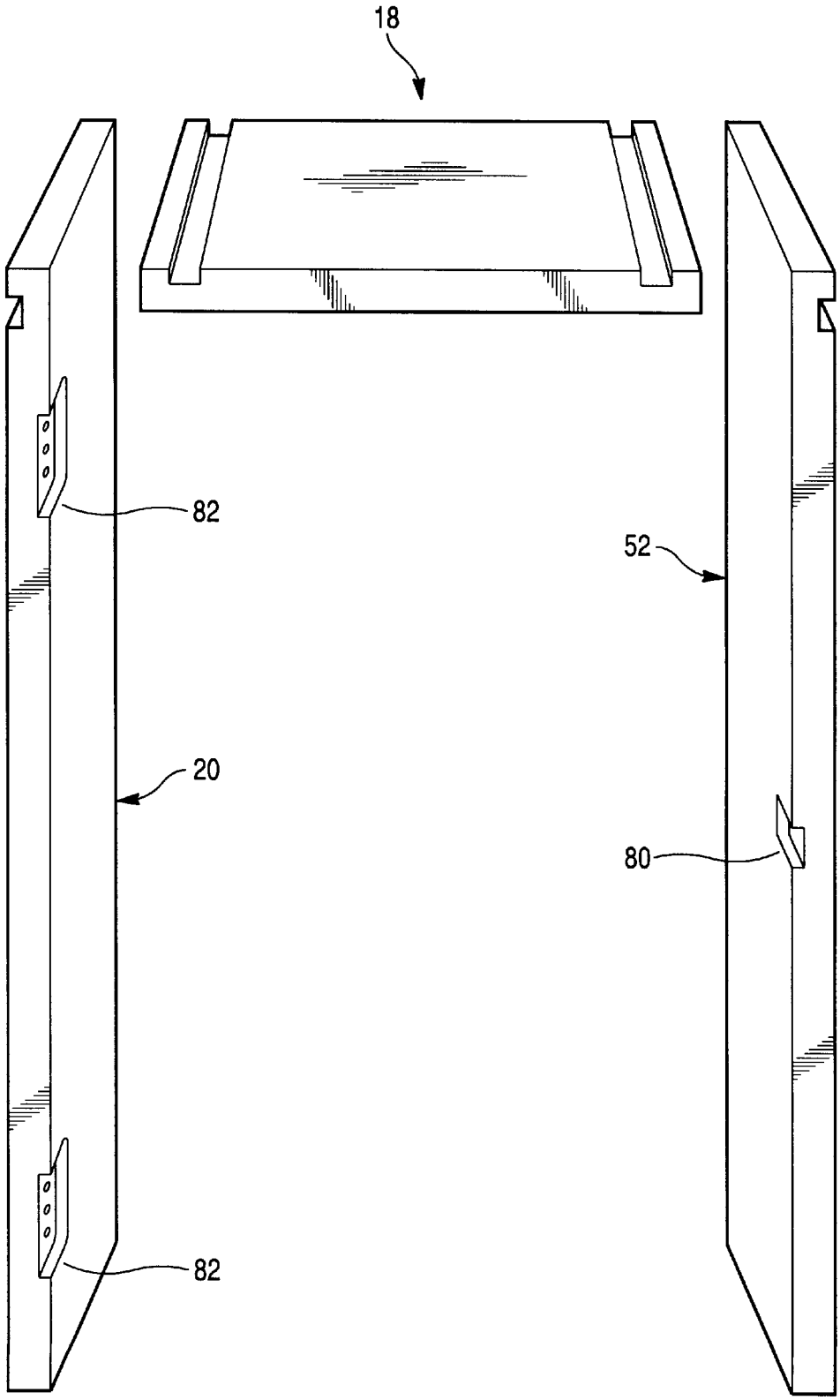
FIG. 4 is an exploded view of an alternative embodiment of the door frame elements shown in FIGS. 2 and 3.

Preferably, the first leg member 20 is adapted to carry a door striker and the second leg member 52 is adapted to carry door hinges. FIG. 3 shows the first leg member 20 as having a striker opening 80 adapted to receive a striker (not shown) and the second leg member 52 as having hinge plate recesses 82 capable of accommodating hinge plates (not shown). FIG. 4, by contrast, shows an alternative arrangement wherein the second leg member 52 has a striker opening 80 adapted to receive a striker (not shown) and the first leg member 20 has hinge plate recesses 82 capable of accommodating hinge plates (not shown). The door frame system 50 of the present invention therefore can be provided in a left-hand-opening configuration or a right-hand-opening configuration depending on the particular or anticipated needs of a consumer.

A more preferred and versatile arrangement, however, can be provided by adapting the door frame system 50 to provide either configuration depending on how the leg members 20,52 are oriented.

Figure 5:
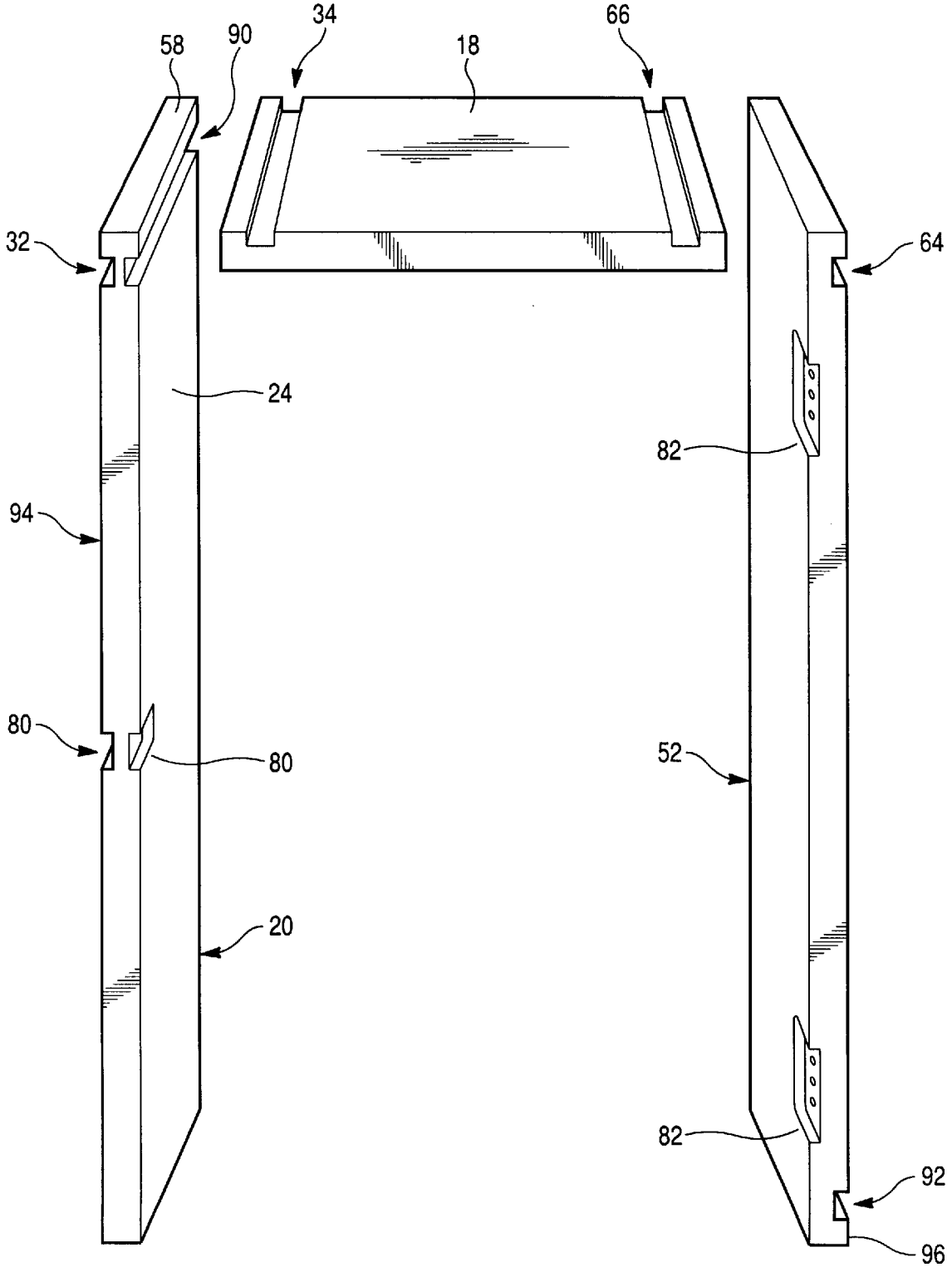
FIG. 5 is an exploded view of another alternative embodiment of the door frame elements shown in FIGS. 2 and 3.

As shown in FIG. 5, according to an alternative embodiment of the present invention, both left-hand-opening and right-hand-opening configurations can be facilitated by providing the first leg member 20 with an inside groove 90 and the second leg member 52 with a second outside groove 92. The inside groove 90 is offset from the first edge 58 of the surface 24 by a distance corresponding to the distance between the apex 12 of the first clip 10 and the distal end 36 of that clip 10. A striker opening 80 is provided on both major surfaces 24,94 of the first leg member 20. The first leg member 20 therefore can be rotated 180 degrees about a longitudinal axis thereof to effect a conversion between right-hand and left-hand door opening configurations. The projection 40 at the distal end 36 of the first clip 10 is receivable by the first inside groove 90 of the first leg member 20 when rotation of the first leg member 20 about its longitudinal axis causes the first inside groove 90 of the first leg member 20 to swap positions with the outside groove 32 of the same leg member 20.

In addition, the second outside groove 92 of the second leg member 52 is offset from a longitudinally opposite outside edge 96 of the second leg member 52 by the distance between the apex 12 of the second clip 10 and the distal end 36 of the second clip 10. The second leg member 52 therefore can be inverted to effect a conversion between the right-hand and left-hand door opening configurations. The projection 40 at the distal end 36 of the second clip 10 is receivable by the second outside groove 92 of the second leg member 52 when inversion of the second leg member 52 causes the second outside groove 92 to swap positions with the first outside groove 64. The hinge recesses 82 preferably are equidistant from the longitudinal midpoint of the second leg member 52. Inversion of the second leg member 52 thus provides conversion between left-hand and right-hand opening configurations.

The resulting arrangement provides a convenient and versatile door frame system 50. The door frame system 50 shown in FIGS. 1–5 can be installed easily, without inadvertently having the leg members 20,52 fall out of alignment with the header 18.

Figure 6:
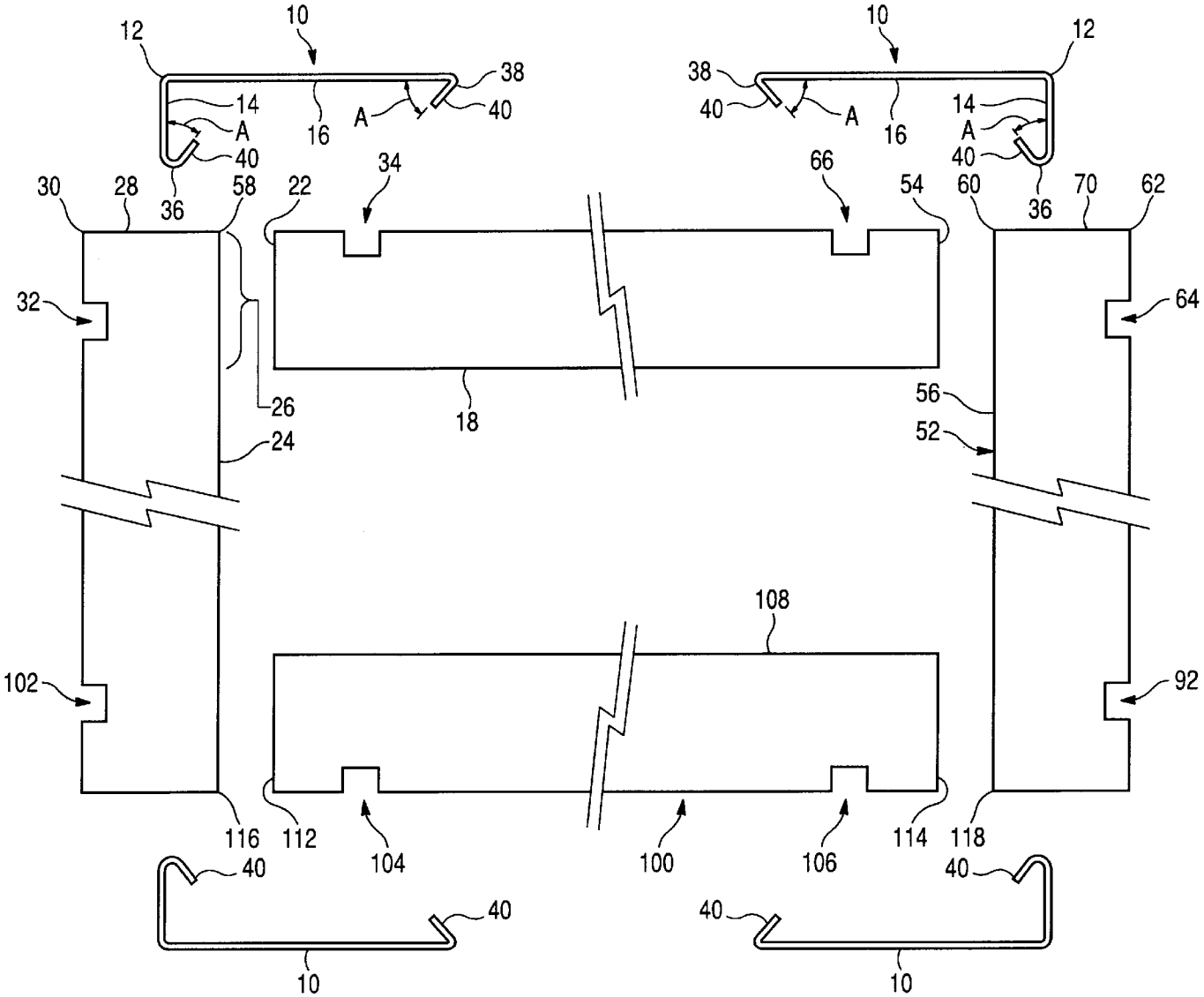
FIG. 6 is a fragmentary, exploded view of the door frame system shown in FIG. 2 when adapted to include a door frame base.

FIG. 6 shows another embodiment of the present invention which is particularly well-suited for situations where it is desirable to install a door frame base, along with the leg members 20,52 and the header 18.

In FIG. 6, a door frame base 100 is secured to the door frame system 50 using third and fourth clips 10. Preferably, the third and fourth clips 10 (at the bottom of FIG. 6) are the same as the aforementioned first and second clips 10 (at the top of FIG. 6) and the door frame base 100 is secured to the leg members 20,52 in substantially the same way as the header 18. Thus, additional grooves 92,102,104,106 are provided to accommodate the projections 40 of the third and fourth clips 10. While the door frame base 100, leg members 20,52, and header 18 have been shown as having relatively planar surfaces all around, it is understood that the invention is not limited to such simplified forms of the base 100, leg members 20,52, and header 18. The door frame base 100, for example, can include a ramp-like extensions (into and out of FIG. 6) to provide a gradual transition into the elevated inside surface 108 of the door frame base 100. Such ramp-like extensions are commonly seen in conventional doors, to avoid tripping on the door frame base.

Figure 7:
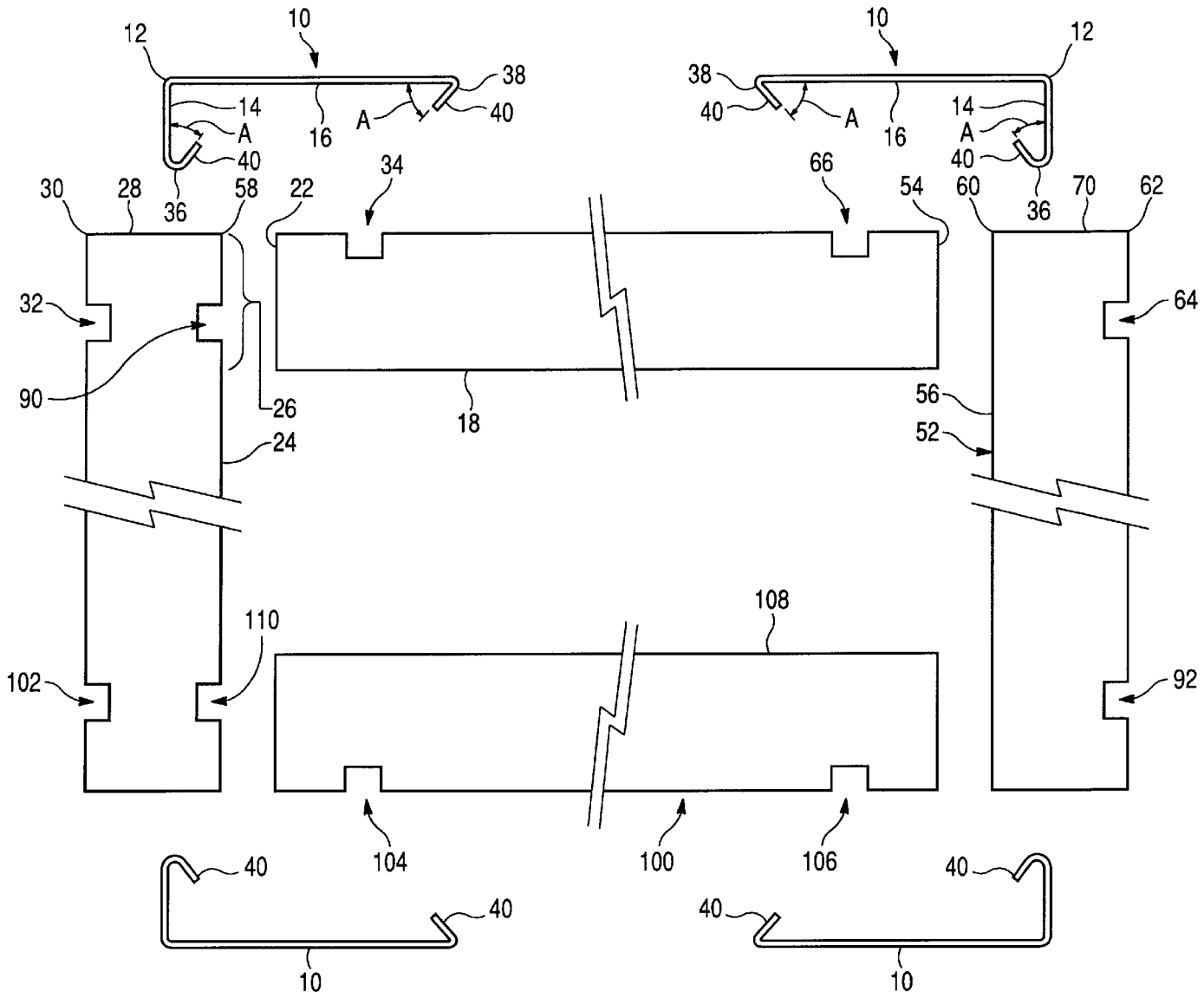
FIG. 7 is a fragmentary, exploded view of the door frame system shown in FIG. 2 when adapted to include a door frame based and to convert between right-hand-opening and left-hand-opening configurations.

As shown in FIG. 7, the embodiment illustrated in FIG. 6 can be adapted for use in both right-hand-opening and left-hand-opening configurations by providing inside grooves 90,110 in the first leg member 20. These inside grooves 90,110 permit the 180-degree rotation of the leg member 20 described above in connection with FIG. 5.

The present invention also provides a method of securing the header 18 of a door frame to the first leg member 20 and the second leg member 52 of the door frame. The method comprises the steps of: locating the header between the first and second leg members 20,52 so that the first and second leg members 20,52 are substantially parallel to one another and so that opposite longitudinal ends 22,54 of the header 18 bear against respective surfaces 24,56 of each of the first and second leg members 20,52 near a first edge 58,60 of each surface 24,56; connecting the first leg member 20 to the header 18 using a first clip (e.g., the clip 10 shown in FIG. 1); and connecting the second leg member 52 to the header 18 using a second clip (e.g., the clip 10 shown in FIG. 1).

Preferably, the step of connecting the first leg member 20 to the header 19 and the step of connecting the second leg member 52 to the header 18 include the steps of: engaging the first outside groove 32 of the first leg member 20 with the distal end 36 of the first clip 10; engaging the first outside groove 64 of the second leg member 52 with the distal end 36 of the second clip 10; engaging the first outside groove 34 of the header 18 with the distal end 38 of the first clip 10; and engaging the second outside groove 66 of the header 18 with the distal end 38 of the second clip 10. Preferably, the projections 40 of the first and second clips 10 are received by the grooves 32,34,64,66 during the aforementioned"engaging" steps.

The method also preferably comprises the steps of: locating a door frame base (e.g., door frame base 100 in FIG. 6) between the first and second leg members 20,52 so that opposite longitudinal ends 112,114 of the door frame base 100 bear against the respective surfaces 24,56 of the leg members 20,52 near a second edge 116,118 of each surface 24,56, which second edges 116,118 are longitudinally opposite to the first inside edges 58,60; connecting the first leg member 20 to the door frame base 100 using a third clip (e.g., the clip 10 shown in FIG. 1); and connecting the second leg member 52 to the door frame base 100 using a fourth clip (e.g., the clip 10 shown in FIG. 1).

The method preferably further comprises the step of converting between left-hand opening and right-hand-opening configurations of the door frame by inverting one of the first and second leg members 20,52 and providing a 180 degree rotation of the other of the first and second leg members 20,52 about a longitudinal axis thereof.

The foregoing door frame system and method provide a convenient and reliable way of securing individual elements of a door frame to one another before and/or after being transported to an installation site, and before insertion into the opening where the door frame will be mounted.

While the present invention has been described with reference to embodiments having more than one inventive aspect, it is understood that the present invention is not limited to such embodiments. To the contrary, each inventive aspect may be practiced individually or in combination with others, without departing from the spirit and scope of the present invention.

Likewise, although this invention has been described as having a preferred design, it is understood that the invention is not limited to the illustrated and described features. The invention is capable of further modifications, usages, and/or adaptations following the general principles of the invention and therefore includes such departures from the present disclosure as come within known or customary practice in the art to which the invention pertains, and as may be applied to the central features set forth above, and which fall within the scope of the appended claims.

What is claimed is:

1. A door frame clip for interconnecting first and second door frame members when a longitudinal end of said first door frame member bears against a surface of said second door frame member at a portion of said surface which is adjacent to a longitudinal end of said second door frame member, said door frame clip comprising:

an apex;

a first arm extending from the apex; and a second arm extending from the apex in a direction which is substantially orthogonal to said first arm, said second arm being significantly longer than said first arm to enable said second arm to reach said first door frame member when said apex engages an outside edge of said longitudinal end of the second door frame member, said first and second arms having distal ends which project toward one another to engage grooves in the first and second door frame members, respectively, said apex having a configuration that is substantially a right angle.

2. The door frame clip of claim 1, wherein said second arm is at least three times as long as said first arm.

3. The door frame clip of claim 2, wherein said first and second arms have distal ends which project toward one another to engage grooves in said second and first door frame members, respectively.

4. The door frame clip of claim 1, wherein said first and second arms are substantially flat.

5. A door frame system comprising:

a first leg member;

a second leg member which is substantially parallel to said first leg member;

a header having opposite longitudinal ends which bear against respective surfaces of each of said leg members near a first edge of each of said respective surfaces;

a first clip for interconnecting said first leg member and said header, said first clip including an apex, a first arm extending from said apex, and a second arm extending from the apex in a direction which is substantially orthogonal to said first arm, said second arm being significantly longer than said first arm to enable said second arm to reach said header when said apex engages an outside edge of said first leg member; and a second clip for interconnecting said second leg member and said header, said second clip including an apex, a first arm extending from the apex of the second clip, and a second arm extending from the apex of the second clip in a direction which is substantially orthogonal to said first arm of the second clip, said second arm of the second clip being significantly longer than said first arm of the second clip to enable said second arm of the second clip to reach said header when said apex of the second clip engages an outside edge of said second leg member.

6. The door frame system of claim 5, further comprising:

a door frame base having opposite longitudinal ends which bear against said respective surfaces of each of said leg members near a second edge of each of said respective surfaces, said second edge of each of said respective surfaces being longitudinally opposite to said first edge of each of said respective surfaces;

a third clip for interconnecting said first leg member and said door frame base, said third clip including an apex, a first arm extending from said apex of the third clip, and a second arm extending from the apex of the third clip in a direction which is substantially orthogonal to said first arm of the third clip, said second arm of the third clip being significantly longer than said first arm of the third clip to enable said second arm of the third clip to reach said door frame base when said apex of the third clip engages a longitudinally opposite outside edge of said first leg member; and a fourth clip for interconnecting said second leg member and said door frame base, said fourth clip including an apex, a first arm extending from the apex of the fourth clip, and a second arm extending from the apex of the fourth clip in a direction which is substantially orthogonal to said first arm of the fourth clip, said second arm of the fourth clip being significantly longer than said first arm of the fourth clip to enable said second arm of the fourth clip to reach said door frame base when said apex of the fourth clip engages a longitudinally opposite outside edge of said second leg member.

7. The door frame system of claim 6, wherein said second arm of each of said first, second, third and fourth clips is at least three times as long as said first arm of each of said first, second, third, and fourth clips.

8. The door frame system of claim 6, wherein said first and second arms of at least one of said first, second, third, and fourth clips have distal ends which project toward one another.

9. The door frame system of claim 6, wherein said first and second arms of said first clip project toward one another to engage grooves in said first leg member and said header, respectively;

wherein said first and second arms of said second clip project toward one another to engage grooves in said second leg member and said header, respectively;

wherein said first and second arms of said third clip project toward one another to engage grooves in said first leg member and said door frame base, respectively; and wherein said first and second arms of said fourth clip project toward one another to engage grooves in said second leg member and said door frame base, respectively.

10. The door frame system of claim 6, wherein said first leg member has a first outside groove which is offset from said outside edge of the first leg member by a distance corresponding to a distance between the apex of said first clip and a distal end of said first arm of the first clip;

wherein said distal end of said first arm of the first clip is adapted to engage said first outside groove of the first leg member;

wherein said first leg member has a second outside groove which is offset from said longitudinally opposite outside edge of the first leg member by a distance corresponding to a distance between the apex of said third clip and a distal end of said first arm of the third clip;

wherein said distal end of said first arm of the third clip is adapted to engage said second outside groove of the first leg member;

wherein said second leg member has a first outside groove which is offset from said outside edge of the second leg member by a distance corresponding to a distance between the apex of said second clip and a distal end of said first arm of the second clip;

wherein said distal end of said first arm of the second clip is adapted to engage said first outside groove of the second leg member;

wherein said second leg member has a second outside groove which is offset from said longitudinally opposite outside edge of the second leg member by a distance corresponding to a distance between the apex of said fourth clip and a distal end of said first arm of the fourth clip;

wherein said distal end of said first arm of the fourth clip is adapted to engage said second outside groove of the second leg member;

wherein said header has a first outside groove which is offset from a first of said opposite longitudinal ends of said header by a distance corresponding to the difference between:

a distance from the apex of said first clip to a distal end of said second arm of the first clip, and a thickness of the first leg member;

wherein said distal end of said second arm of the first clip is adapted to engage said first outside groove of the header;

wherein said header has a second outside groove which is offset from a second of said opposite longitudinal ends of said header by a distance corresponding to the difference between:

a distance from the apex of said second clip to a distal end of said second arm of the second clip, and a thickness of the second leg member;

wherein said distal end of said second arm of the second clip is adapted to engage said second outside groove of the header;

wherein said door frame base has a first outside groove which is offset from a first of said opposite longitudinal ends of said door frame base by a distance corresponding to the difference between:

a distance from the apex of said third clip to a distal end of said second arm of the third clip, and a thickness of the first leg member;

wherein said distal end of said second arm of the third clip is adapted to engage said first outside groove of the door frame base;

wherein said door frame base has a second outside groove which is offset from a second of said opposite longitudinal ends of said door frame base by a distance corresponding to the difference between:

a distance from the apex of said fourth clip to a distal end of said second arm of the fourth clip, and a thickness of the second leg member; and wherein said distal end of said second arm of the fourth clip is adapted to engage said second outside groove of the door frame base.

11. The door frame system of claim 10, wherein said distal end of said first arm of the first clip has a projection which is receivable by said first outside groove of the first leg member;

wherein said distal end of said first arm of the third clip has a projection which is receivable by said second outside groove of the first leg member;

wherein said distal end of said first arm of the second clip has a projection which is receivable by said first outside groove of the second leg member;

wherein said distal end of said first arm of the fourth clip has a projection which is receivable by said second outside groove of the second leg member;

wherein said distal end of said second arm of the first clip has a projection which is receivable by said first outside groove of the header;

wherein said distal end of said second arm of the second clip has a projection which is receivable by said second outside groove of the header;

wherein said distal end of said second arm of the third clip has a projection which is receivable by said first outside groove of the door frame base; and wherein said distal end of said second arm of the fourth clip has a projection which is receivable by said second outside groove of the door frame base.

12. The door frame system of claim 5, wherein said second arm of each of said first and second clips is at least three times as long as said first arm of each of said first and second clips.

13. The door frame system of claim 5, wherein said first and second arms of at least one of said first and second clips have distal ends which project toward one another.

14. The door frame system of claim 5, wherein said first and second arms of said first clip project toward one another to engage grooves in said first leg member and said header, respectively; and wherein said first and second arms of said second clip project toward one another to engage grooves in said second leg member and said header, respectively.

15. The door frame system of claim 5, wherein said first leg member has a first outside groove which is offset from said outside edge of the first leg member by a distance corresponding to a distance between the apex of said first clip and a distal end of said first arm of the first clip;

wherein said distal end of said first arm of the first clip is adapted to engage said first outside groove of the first leg member;

wherein said second leg member has a first outside groove which is offset from said outside edge of the second leg member by a distance corresponding to a distance between the apex of said second clip and a distal end of said first arm of the second clip;

wherein said distal end of said first arm of the second clip is adapted to engage said first outside groove of the second leg member;

wherein said header has a first outside groove which is offset from a first of said opposite longitudinal ends of said header by a distance corresponding to the difference between:

a distance from the apex of said first clip to a distal end of said second arm of the first clip, and a thickness of the first leg member;

wherein said distal end of said second arm of the first clip is adapted to engage said first outside groove of the header;

wherein said header has a second outside groove which is offset from a second of said opposite longitudinal ends of said header by a distance corresponding to the difference between:

a distance from the apex of said second clip to a distal end of said second arm of the second clip, and a thickness of the second leg member;

wherein said distal end of said second arm of the second clip is adapted to engage said second outside groove of the header.

16. The door frame system of claim 15, wherein said distal end of said first arm of the first clip has a projection which is receivable by said first outside groove of the first leg member;

wherein said distal end of said first arm of the second clip has a projection which is receivable by said first outside groove of the second leg member;

wherein said distal end of said second arm of the first clip has a projection which is receivable by said first outside groove of the header; and wherein said distal end of said second arm of the second clip has a projection which is receivable by said second outside groove of the header.

17. The door frame system of claim 16, wherein said first leg member is adapted to carry a door striker and said second leg member is adapted to carry door hinges;

wherein said first leg member includes a first inside groove which is offset from said first edge of the respective surface of the first leg member by said distance corresponding to the distance between the apex of said first clip and said distal end of said first arm of the first clip, so that said first leg member can be rotated 180 degrees about a longitudinal axis thereof to effect a conversion between right-hand and left-hand door opening configurations, said projection of the distal end of said first arm of the first clip being receivable by said first inside groove of the first leg member when rotation of said first leg member about its longitudinal axis causes said first inside groove of said first leg member to swap positions with said first outside groove of said first leg member; and wherein said second leg member includes a second outside groove which is offset from a longitudinally opposite outside edge of the second leg member by said distance corresponding to the distance between the apex of said second clip and said distal end of said first arm of the second clip, so that said second leg member can be inverted to effect a conversion between said right-hand and left-hand door opening configurations, said projection of the distal end of said first arm of the second clip being receivable by said second outside groove of the second leg member when inversion of said second leg member causes said second outside groove of said second leg member to swap positions with said first outside groove of said second leg member.

18. The door frame system of claim 16, wherein said first outside groove of the header is offset from said first of said opposite longitudinal ends of said header by a distance which is substantially equal to the thickness of the first leg member, whereby said distance from the apex of said first clip to a distal end of said second arm of the first clip is substantially equal to twice the thickness of said first leg member; and wherein said second outside groove of the header is offset from said second of said opposite longitudinal ends of said header by a distance which is substantially equal to the thickness of the second leg member, whereby said distance from the apex of said second clip to a distal end of said second arm of the second clip is substantially equal to twice the thickness of said second leg member.

19. The door frame system of claim 18, wherein said first outside groove of said first leg member is offset from said first outside edge of said first leg member by a distance which is substantially equal to half of said thickness of the first leg member; and wherein said first outside groove of said second leg member is offset from said first outside edge of said second leg member by a distance which is substantially equal to half of said thickness of the second leg member.

20. The door frame system of claim 19, wherein said first leg member, said second leg member, and said header are of substantially equal thickness.

21. The door frame system of claim 15, wherein said first leg member is adapted to carry a door striker and said second leg member is adapted to carry door hinges;

wherein said first leg member includes a first inside groove which is offset from said first edge of the respective surface of the first leg member by said distance corresponding to the distance between the apex of said first clip and said distal end of said first arm of the first clip, so that said first leg member can be rotated 180 degrees about a longitudinal axis thereof to effect a conversion between right-hand and left-hand door opening configurations, said distal end of said first arm of the first clip being adapted to engage said first inside groove of the first leg member when rotation of said first leg member about its longitudinal axis causes said first inside groove of said first leg member to swap positions with said first outside groove of said first leg member; and wherein said second leg member includes a second outside groove which is offset from a longitudinally opposite outside edge of the second leg member by said distance corresponding to the distance between the apex of said second clip and said distal end of said first arm of the second clip, so that said second leg member can be inverted to effect a conversion between said right-hand and left-hand door opening configurations, said distal end of said first arm of the second clip being adapted to engage said second outside groove of the second leg member when inversion of said second leg member causes said second outside groove of said second leg member to swap positions with said first outside groove of said second leg member.

22. The door frame system of claim 15, wherein said first outside groove of the header is offset from said first of said opposite longitudinal ends of said header by a distance which is substantially equal to the thickness of the first leg member, whereby said distance from the apex of said first clip to a distal end of said second arm of the first clip is substantially equal to twice the thickness of said first leg member; and wherein said second outside groove of the header is offset from said second of said opposite longitudinal ends of said header by a distance which is substantially equal to the thickness of the second leg member, whereby said distance from the apex of said second clip to a distal end of said second arm of the second clip is substantially equal to twice the thickness of said second leg member.

23. The door frame system of claim 22, wherein said first outside groove of said first leg member is offset from said first outside edge of said first leg member by a distance which is substantially equal to half of said thickness of the first leg member; and wherein said first outside groove of said second leg member is offset from said first outside edge of said second leg member by a distance which is substantially equal to half of said thickness of the second leg member.

24. The door frame system of claim 23, wherein said first leg member, said second leg member, and said header are of substantially equal thickness.

25. The door frame system of claim 5, wherein said first and second arms are substantially flat.

26. A method of securing a header of a door frame to a first leg member and a second leg member of the door frame, said method comprising the steps of:

locating said header between said first and second leg members so that said first and second leg members are substantially parallel to one another and so that opposite longitudinal ends of said header bear against respective surfaces of each of said first and second leg members near a first edge of each of said respective surfaces;

connecting said first leg member to said header using a first clip, said first clip including an apex, a first arm extending from said apex, and a second arm extending from the apex in a direction which is substantially orthogonal to said first arm, said second arm being significantly longer than said first arm to enable said second arm to reach said header when said apex engages an outside edge of said first leg member; and connecting said second leg member to said header using a second clip, said second clip including an apex, a first arm extending from the apex of the second clip, and a second arm extending from the apex of the second clip in a direction which is substantially orthogonal to said first arm of the second clip, said second arm of the second clip being significantly longer than said first arm of the second clip to enable said second arm of the second clip to reach said header when said apex of the second clip engages an outside edge of said second leg member.

27. The method of claim 26, wherein said first leg member has a first outside groove which is offset from said outside edge of the first leg member by a distance corresponding to a distance between the apex of said first clip and a distal end of said first arm of the first clip;

wherein said second leg member has a first outside groove which is offset from said outside edge of the second leg member by a distance corresponding to a distance between the apex of said second clip and a distal end of said first arm of the second clip;

wherein said header has a first outside groove which is offset from a first of said opposite longitudinal ends of said header by a distance corresponding to the difference between:

a distance from the apex of said first clip to a distal end of said second arm of the first clip, and a thickness of the first leg member;

wherein said header has a second outside groove which is offset from a second of said opposite longitudinal ends of said header by a distance corresponding to the difference between:

a distance from the apex of said second clip to a distal end of said second arm of the second clip, and a thickness of the second leg member; and wherein said step of connecting said first leg member to said header and said step of connecting said second leg member to said header include the steps of:

engaging said first outside groove of the first leg member with said distal end of said first arm of the first clip;

engaging said first outside groove of the second leg member with said distal end of said first arm of the second clip;

engaging said first outside groove of the header with said distal end of said second arm of the first clip; and engaging said second outside groove of the header with said distal end of said second arm of the second clip.

28. The method of claim 27, wherein said distal end of said first arm of the first clip has a projection which is received by said first outside groove of the first leg member during said step of engaging said first outside groove of the first leg member with said distal end of said first arm of the first clip;

wherein said distal end of said first arm of the second clip has a projection which is received by said first outside groove of the second leg member during said step of engaging said first outside groove of the second leg member with said distal end of said first arm;

wherein said distal end of said second arm of the first clip has a projection which is received by said first outside groove of the header during said step of engaging said first outside groove of the header with said distal end of said second arm of the first clip; and wherein said distal end of said second arm of the second clip has a projection which is received by said second outside groove of the header during said step of engaging said second outside groove of the header with said distal end of said second arm.

29. The method of claim 26, further comprising the steps of:

locating a door frame base between said first and second leg members so that opposite longitudinal ends of said door frame base bear against said respective surfaces of each of said leg members near a second edge of each of said respective surfaces, said second edge of each of said respective surfaces being longitudinally opposite to said first edge of each of said respective surfaces;

connecting said first leg member to said door frame base using a third clip, said third clip including an apex, a first arm extending from said apex of the third clip, and a second arm extending from the apex of the third clip in a direction which is substantially orthogonal to said first arm of the third clip, said second arm of the third clip being significantly longer than said first arm of the third clip to enable said second arm of the third clip to reach said door frame base when said apex of the third clip engages a longitudinally opposite outside edge of said first leg member; and connecting said second leg member to said door frame base using a fourth clip, said fourth clip including an apex, a first arm extending from the apex of the fourth clip, and a second arm extending from the apex of the fourth clip in a direction which is substantially orthogonal to said first arm of the fourth clip, said second arm of the fourth clip being significantly longer than said first arm of the fourth clip to enable said second arm of the fourth clip to reach said door frame base when said apex of the fourth clip engages a longitudinally opposite outside edge of said second leg member.

30. The method of claim 26, further comprising the step of converting between lefthand-opening and right-hand-opening configurations of the door frame by inverting one of said first and second leg members and providing a 180 degree rotation of the other of said first and second leg members about a longitudinal axis thereof.

* * * * *